US008517619B1

(12) United States Patent
Vandermeulen

(10) Patent No.: US 8,517,619 B1
(45) Date of Patent: Aug. 27, 2013

(54) PRINTING APPARATUS

(75) Inventor: Kris Vandermeulen, Bornem (BE)

(73) Assignee: DYMO, Sint-Niklaas (BE)

( * ) Notice: Subject to any disclaimer, the term of this patent is extended or adjusted under 35 U.S.C. 154(b) by 499 days.

(21) Appl. No.: 12/091,276

(22) PCT Filed: Dec. 20, 2007

(86) PCT No.: PCT/IB2007/004456

§ 371 (c)(1),
(2), (4) Date: May 6, 2008

(87) PCT Pub. No.: WO2008/078201

PCT Pub. Date: Jul. 3, 2008

(30) Foreign Application Priority Data

Dec. 22, 2006 (GB) ..... 0625815.6
Oct. 5, 2007 (EP) ..... 07253954

(51) Int. Cl.
*B41J 11/00* (2006.01)
*B26D 5/08* (2006.01)

(52) U.S. Cl.
USPC ..... 400/621; 83/596; 83/603

(58) Field of Classification Search
USPC ..... 400/593, 621; 83/602, 596, 603, 83/648, 694
See application file for complete search history.

(56) References Cited

U.S. PATENT DOCUMENTS

| | | | | |
|---|---|---|---|---|
| 5,599,119 | A | 2/1997 | Nunokawa et al. | |
| 5,658,083 | A | 8/1997 | Day et al. | |
| 5,971,639 | A * | 10/1999 | Park | 400/621 |
| 6,074,113 | A | 6/2000 | Cockerill et al. | |
| 6,347,896 | B1 * | 2/2002 | Robinson | 400/621 |
| 7,156,568 | B2 * | 1/2007 | Miyasaka | 400/621 |

FOREIGN PATENT DOCUMENTS

| | | |
|---|---|---|
| EP | 0 534 799 | 3/1993 |
| EP | 0 634 275 A2 | 1/1995 |
| EP | 0 711 637 | 5/1996 |
| EP | 0 764 542 | 3/1997 |
| EP | 0 798 254 | 10/1997 |
| WO | WO-98/56547 | 12/1998 |

OTHER PUBLICATIONS

European Search Report for Application No. EP 07253957, dated Apr. 11, 2008.
International Search Report for International Application No. PCT/IDS2007/004456, dated Sep. 23, 2008.
Extended European Search Report for Application No. 11154198.3, dated Mar. 15, 2011.

* cited by examiner

*Primary Examiner* — Matthew G Marini
(74) *Attorney, Agent, or Firm* — Marshall, Gerstein & Borun LLP

(57) ABSTRACT

A tape printer for printing an image on an image receiving medium including a tape receiving portion for receiving a supply of image receiving medium on which an image is to be printed; a printing mechanism arranged to print an image on said medium; a cutting mechanism for cutting off a portion of said medium, wherein the cutting mechanism comprises a cutter guide track defining a predetermined path for guiding a cutter of the cutting mechanism, wherein different parts of the cutter intersect the medium as the cutter moves to cut off said portion.

27 Claims, 23 Drawing Sheets

PRINTING APPARATUS

REFERENCE TO RELATED APPLICATIONS

This is the United States National Phase under 35 U.S.C. §371 of international application no. PCT/182007/004456, having an international filing date of Dec. 20, 2007, and claims priority to United Kingdom patent application GB 0625815.6, filed Dec. 22, 2006, and European patent application EP 07253954.7, filed Oct. 5, 2007.

FIELD OF THE DISCLOSURE

The present disclosure relates to a tape printing apparatus and to a method of printing on a tape to form a label. In particular, the present disclosure relates to a tape printing apparatus having a cutter arranged to cut the tape, so that the tape forms a label.

BACKGROUND OF THE DISCLOSURE

Tape printers are known which use a supply of tape, housed in a cassette received in the tape printer. The tape comprises an image receiving layer and a backing layer which are secured to one another via an adhesive layer. After an image has been printed onto the image receiving layer, the backing layer can be removed allowing the image receiving layer to be secured to an object using the adhesive layer. Such tape printers include a cutting mechanism for cutting off a portion of the tape after an image has been printed onto the image receiving layer so that the portion of tape can be used as a label. For this purpose the cutting mechanism includes a blade which is intended to cut through all the layers of the tape.

The cutting mechanism in these known tape printers can be operated by the user manually. Alternatively the cutting mechanism may be driven by a motor in the tape printer. Some examples of automatic cutting mechanisms are described in EP-A-534799, EPA-929402, EP-A-764542 and U.S. Pat. No. 5,599,119. An embodiment of an automatic cutter is incorporated into the DYMO PC-10 Electronic Label maker.

A relatively large force needs to be applied by the blade on the tape in order to perform the cutting operation. Over time, continual cutting operations cause the blade to wear. This is disadvantageous since it is not desirable for a user of the printer to change the blade during the lifetime of the printer. Furthermore the force required to cut the tape can often distort the tape and in some cases cause the tape to move during the cutting operation. As the blade wears the tape is more likely to distort during the cutting operation. Distortion of the tape during cutting may result in a label having a cut edge that is not smooth.

The force required to cut the tape may also cause the position of a tape cassette housing the tape to displace during cutting. This causes further problems such as incomplete cutting of the tape, and misalignment of the printed image on the tape in subsequent printing operations.

It is therefore an aim of the present disclosure to overcome the disadvantages discussed above.

SUMMARY OF THE DISCLOSURE

According to a first aspect of the present disclosure there is provided a tape printer for printing an image on an image receiving medium comprising: a tape receiving portion for receiving a supply of image receiving medium on which an image is to be printed; a printing mechanism arranged to print an image on said medium; a cutting mechanism for cutting off a portion of said medium, wherein the cutting mechanism comprises a cutter guide track defining a predetermined path for guiding a cutter of the cutting mechanism, wherein different parts of the cutter intersect the medium as the cutter moves to cut off said portion.

According to a second aspect of the present disclosure there is provided a method of cutting a portion of an image receiving medium to form a label comprising; guiding a cutter to move along a guide track defining a predetermined path whereby different parts of the cutter intersect the image receiving medium as the cutter moves as the cutter moves to cut off said portion.

According to a third aspect of the present disclosure there is provided a printer for printing an image on an image receiving medium comprising: a receiving portion for receiving a supply of image receiving medium on which an image is to be printed; a printing mechanism arranged to print an image on said medium; a cutting mechanism for cutting off a portion of said medium, wherein the cutting mechanism comprises a cutter guide track defining a predetermined path for guiding a cutter of the cutting mechanism, wherein different parts of the cutter intersect the medium as the cutter moves to cut off said portion.

According to a fourth aspect of the present disclosure there is provided a tape printer for printing an image on an image receiving medium comprising: a tape receiving portion for receiving a supply of image receiving medium on which an image is to be printed; a printing mechanism arranged to print an image on said medium; and a cutting mechanism for cutting off a portion of said medium, wherein the cutting mechanism comprises a cutter guide track defining a predetermined path for guiding a cutter of the cutting mechanism during a cutting cycle, wherein during a first portion of the cutting cycle the guide track is arranged to guide the cutter to intersect a plane of the medium such that a portion of the medium is cut off, and wherein during a second portion of the cycle the guide track is arranged to guide the cutter to return to a home position such that the cutter does not intersect the plane of the medium.

According to a fifth aspect of the present disclosure there is provided a method of cutting an image receiving medium to form a label comprising; guiding a cutter to move along a predetermined path during a cutting cycle, wherein during a first portion of the cutting cycle the guide track is arranged to guide the cutter to intersect a plane of the medium such that a portion of the medium is cut off, and wherein during a second portion of the cycle the guide track is arranged to guide the cutter to return to a home position such that the cutter does not intersect the plane of the medium.

BRIEF DESCRIPTION OF DRAWINGS

For a better understanding of the present disclosure and to show how the same may be carried into effect reference will now be made by way of example to the accompanying drawings in which.

DETAILED DESCRIPTION OF EMBODIMENTS OF THE DISCLOSURE

Figure 11:
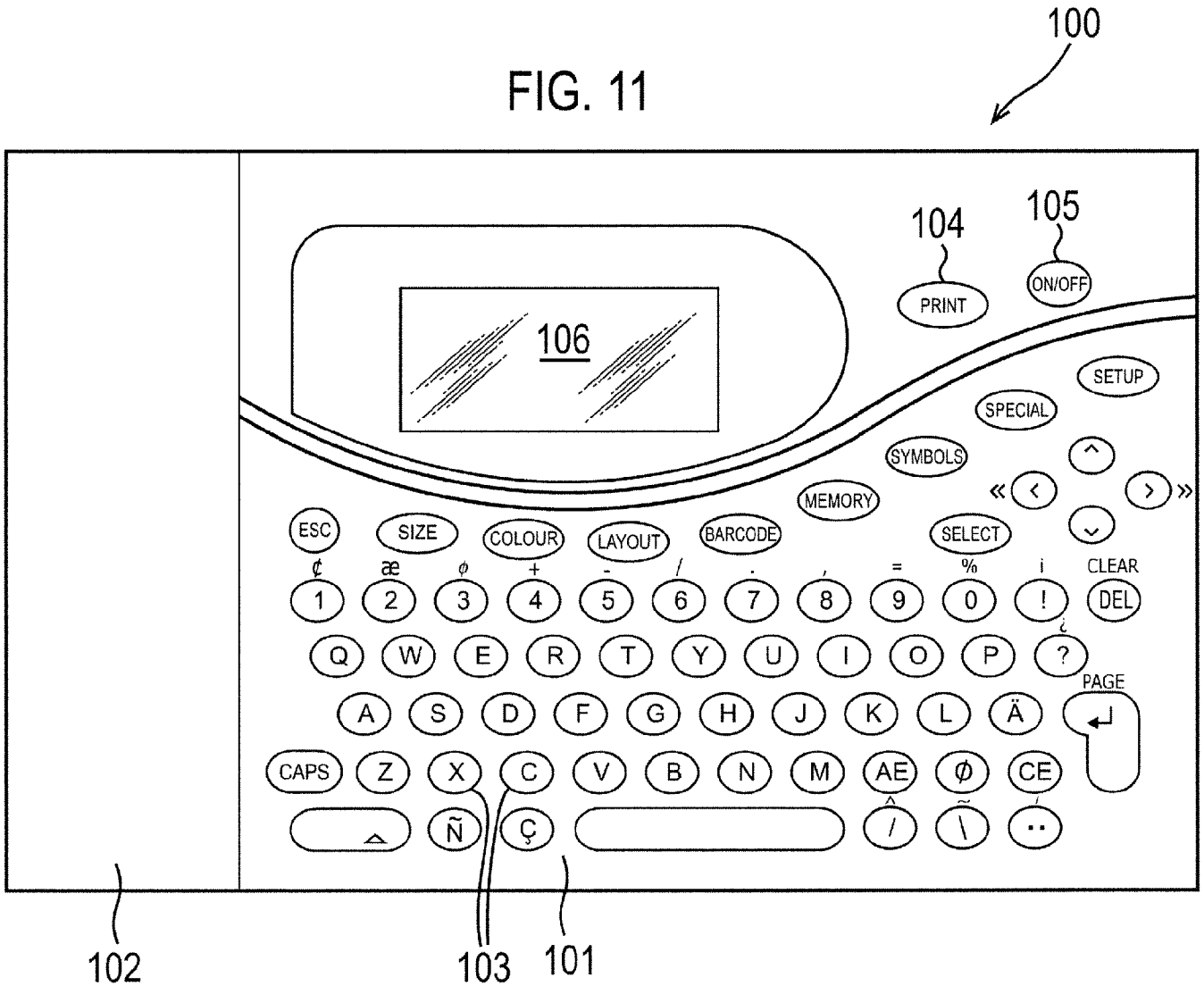
FIG. 11 shows a tape printer in accordance with an embodiment of the present disclosure.

FIG. 11 shows a schematic diagram of a tape printing apparatus 100 according to an embodiment of the present disclosure. The tape printing apparatus comprises a keyboard 101 and a cassette receiving bay 102.

The cassette receiving bay 102 houses a cassette containing image receiving tape on which a label is printed. The image receiving tape has an image receiving layer for receiving the image and an adhesive layer for allowing the label to be adhered to a surface.

The keyboard has a plurality of data entry keys 103 such as numbered, lettered and punctuation keys for inputting data to be printed as a label and function keys for editing the input data. The keyboard may also have a print key 104 which is operated when it is desired that a label be printed. Additionally an on/off key 105 is also provided for switching the tape printing apparatus on and off.

The tape printing apparatus has a liquid crystal display (LCD) 106 which displays the data as it is entered. The display allows the user to view all or part of the label to be printed which facilitates the editing of the label prior to its printing. Additionally, the display is driven by a display driver (not shown).

Figure 12:
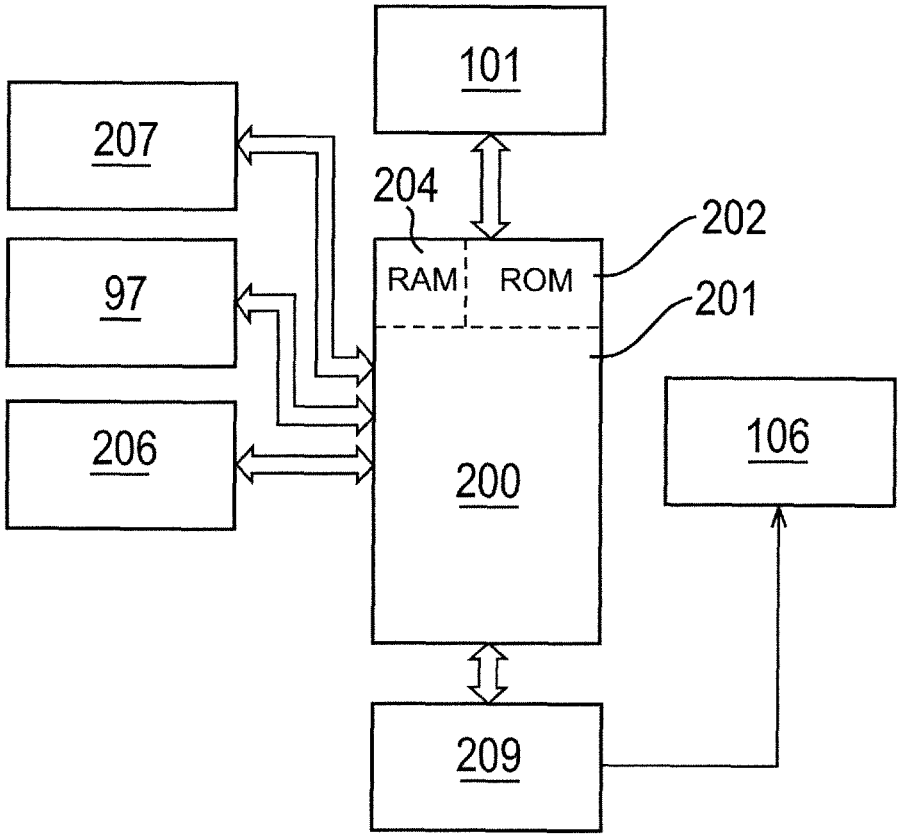
FIG. 12 shows the basic circuitry for controlling a tape printer in accordance with an embodiment of the present disclosure.

Basic circuitry for controlling the tape printing device 100 is shown in FIG. 12. There is a microprocessor chip 200 having a read only memory (ROM) 202, a microprocessor 201 and random access memory capacity indicated diagrammatically by RAM 204. The microprocessor chip 200 is connected to receive label data input to it from a data input device such as the keyboard 101. The microprocessor chip 200 outputs data to drive the display 106 via a display driver chip 209 to display a label to be printed (or a part thereof) and/or a message for the user. The display driver alternatively may form part of the microprocessor chip. Additionally, the microprocessor chip 200 also outputs data to drive a print head 206 so that the label data is printed onto the image receiving tape to form a label. The microprocessor chip 200 also controls a motor 207 for driving the tape. Finally the microprocessor chip 100 also controls a motor 97 for operating a cutting mechanism 58 to allow a length of tape to be cut off. The manner in which the cutting mechanism is controlled will be discussed hereinafter.

Figure 13:
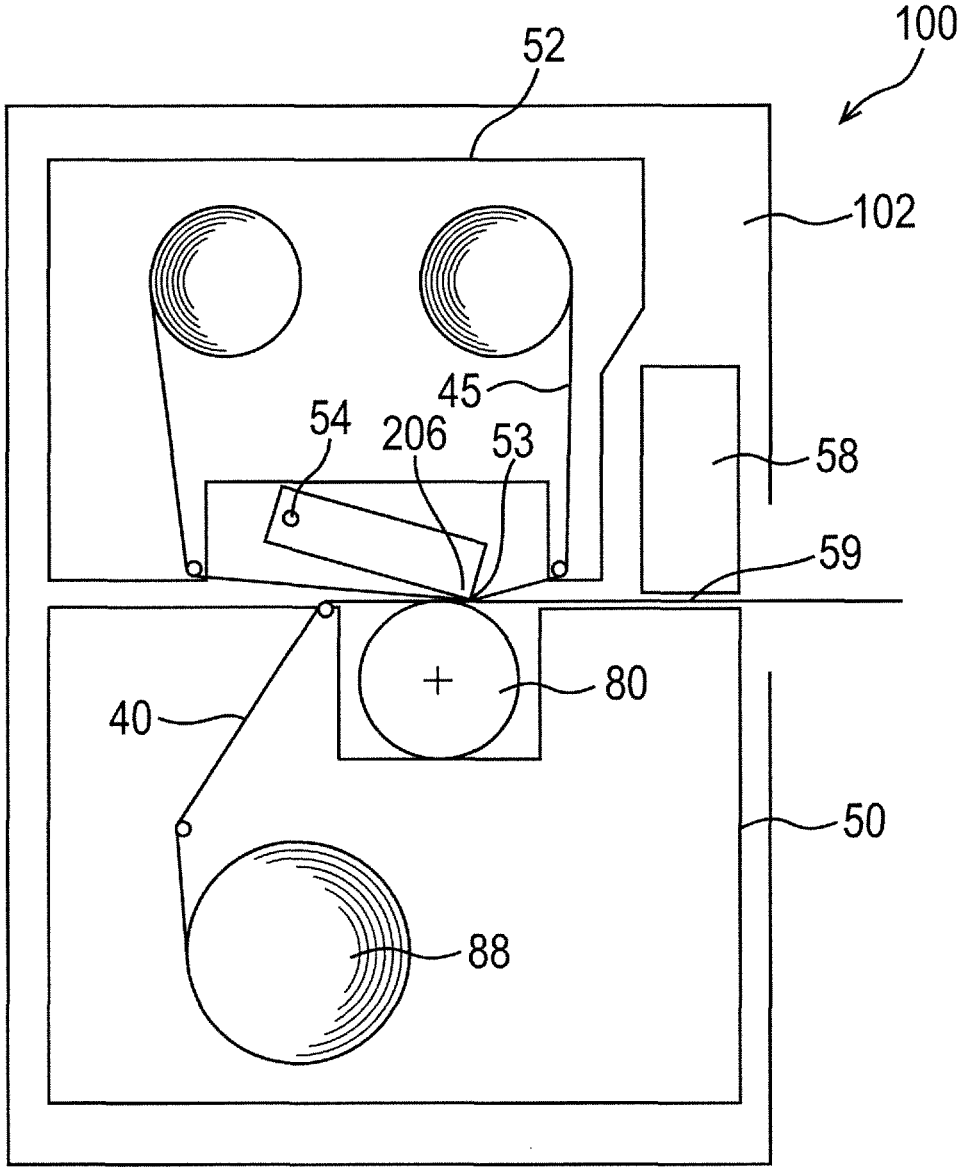
FIG. 13 shows a cassette receiving bay of the tape printer in accordance with an embodiment of the present disclosure.

In one embodiment of the disclosure the tape printer 100 may be arranged print to an image on an image receiving tape using an ink ribbon. This method of printing is known as thermal transfer printing. FIG. 13 shows a schematic diagram of a cassette receiving bay 102 in the tape printing apparatus 100 arranged to print by thermal transfer. In this embodiment an ink ribbon cassette 52 containing an ink ribbon 45 is installed together with an image receiving tape cassette 50 in the cassette receiving bay 102. The image receiving tape cassette 50 contains a supply of image receiving tape 40 provided on a supply spool 88.

The cassette bay 102 also accommodates at least one thermal print head 206 and a platen 80 which cooperate to define a print zone 53. The print head 206 is able to pivot about a pivot point 54 so that it can be brought into contact with the platen 80 for printing and moved away from the platen 80 to enable the cassette 50 to be removed and replaced. In the operative position, in one embodiment of the disclosure the platen 80 is rotated by a motor 207 (FIG. 12) to cause the tape 40 to be driven past the print head 206 to the cutting zone 59.

The ink ribbon 45 passes through the print zone together with the image receiving tape 40. According to this embodiment of the disclosure the image receiving tape 40 is an ink receiving tape.

In an alternative embodiment of the disclosure the image receiving tape 40 is a direct thermal material. In this embodiment of the invention the print head 206 produces an image on the tape by applying heat directly to the tape 40. Accordingly when the image receiving tape cassette 50 includes direct thermal tape 40 there is no need to provide an ink ribbon cassette 52 in the cassette receiving bay 102 of the printer 100.

In one embodiment of the invention the image receiving tape may comprise a continuous image receiving layer. In an alternative embodiment of the present invention the image receiving tape may comprise die cut labels.

Figure 1:
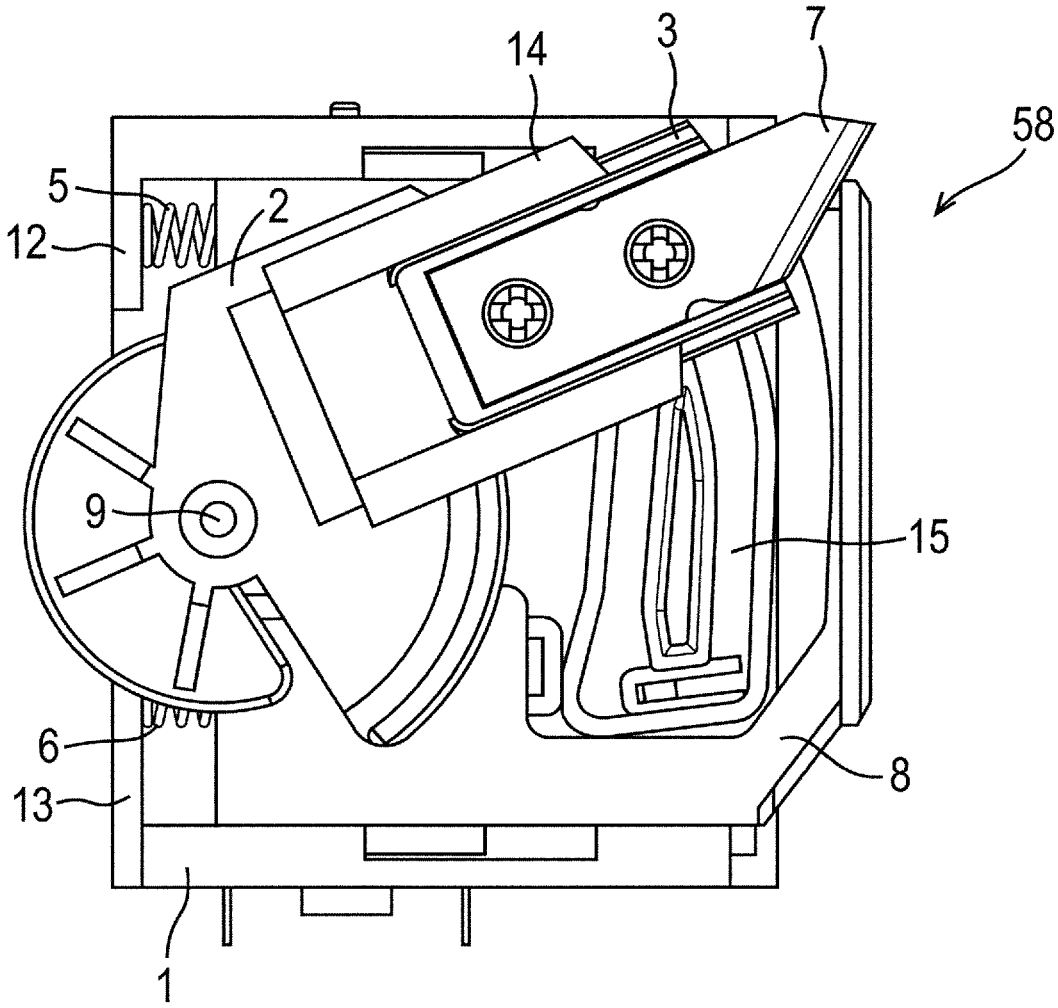
FIG. 1 shows a cutter mechanism in accordance with an embodiment of the present disclosure.

Reference is now made to FIG. 1. FIG. 1 shows a cutter mechanism according to an embodiment of the present disclosure. The cutter mechanism includes a cutter support 1, a rotating blade support 2, a translating blade support 3 on which a blade 7 is fixed and a clamp 8.

Figure 3:
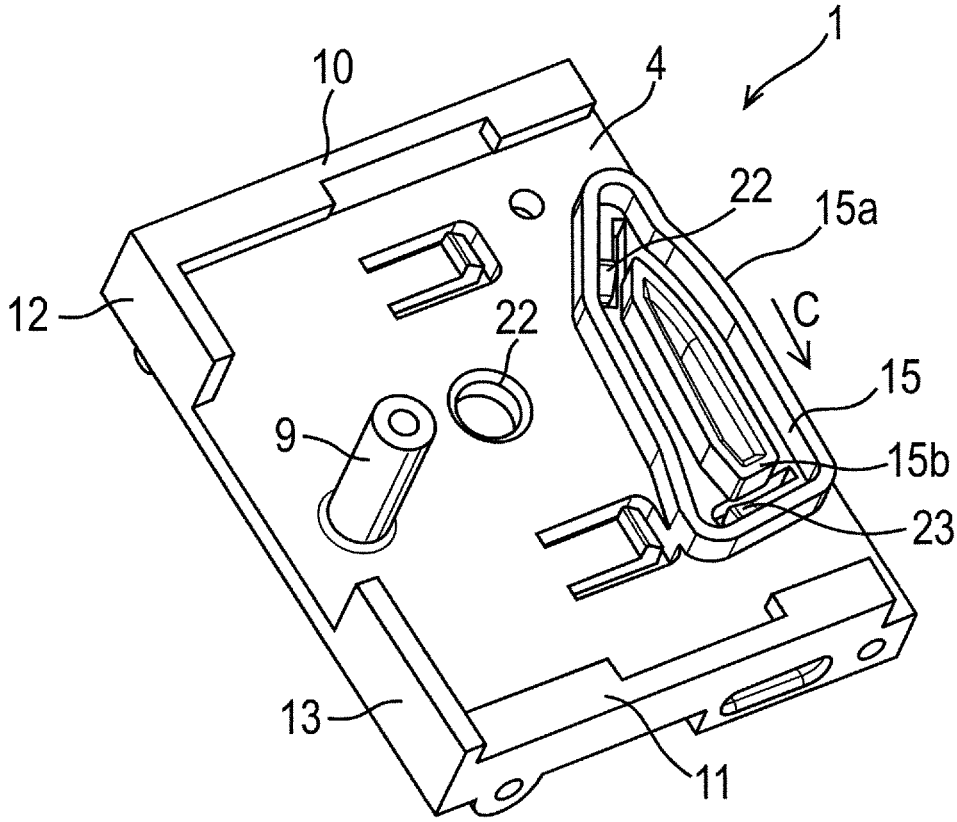
FIG. 3 shows a cutter support of the cutter mechanism in accordance with an embodiment of the present disclosure.

FIG. 3 shows the cutter support 1 in more detail. A guide track 15 is provided on the base 4 of the cutter support. The guide track 15 defines a substantially oval path between two walls 15*a* and 15*b*. Although the guide track is shown to be substantially oval in FIG. 3 in other embodiments of the invention the guide track may define a predetermined path of any other shape.

Figure 14:
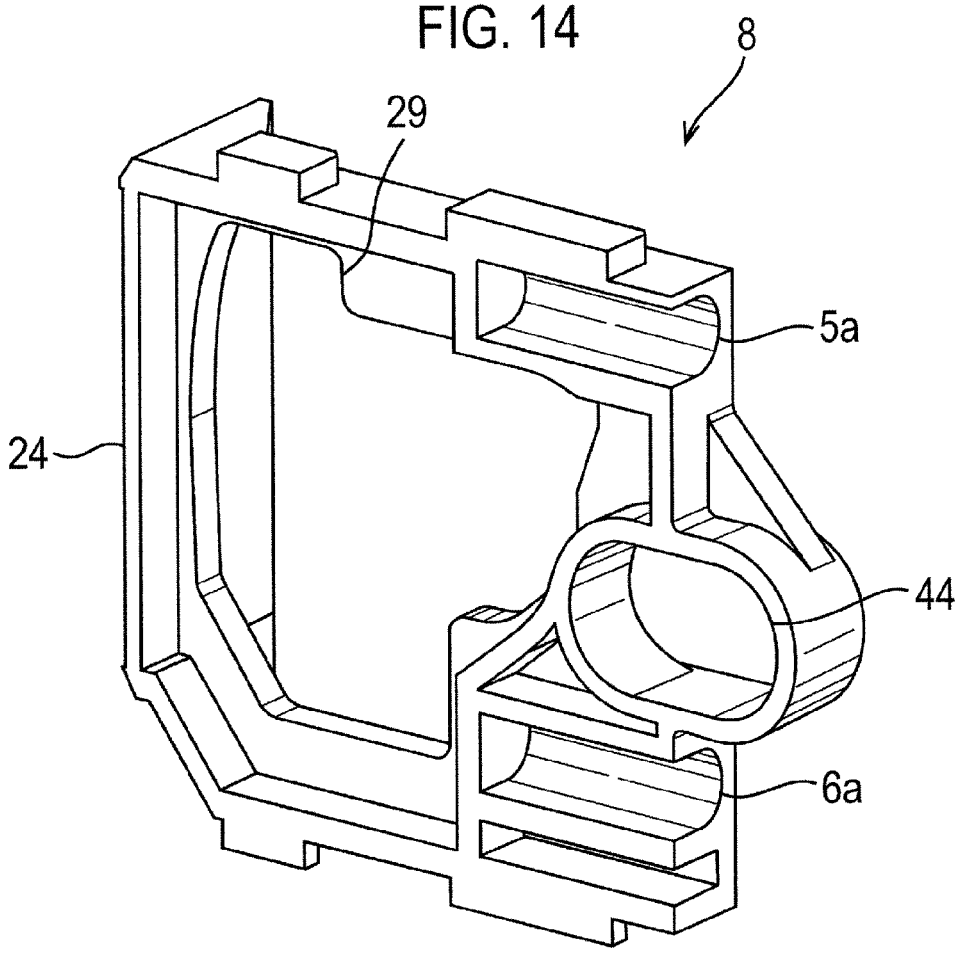
FIG. 14 shows a clamp of the cutter mechanism in accordance with an embodiment of the present disclosure.

A support member 9 extends perpendicularly from the base 4 of the cutter support. The cutter support 1 further comprises end panels 12 and 13, side panels 10 and 11. A hole 22 is also provided in the base 4 of the cutter support 1. As shown in FIG. 1 the clamp 8 is located between the cutter support 1 and the rotating blade support 2. The clamp 8 is shown in more detail in FIG. 14. FIG. 14 shows the side of the clamp 8 that is positioned against the base 4 of the cutter support 1. The clamp 8 comprises a clamping face 24 and two spring receiving recesses 5*a* and 6*a* located at the opposite end of the clamp to the clamping face 24. The clamp has a cut out section 29, which exposes the guide track 15 when the clamp is attached to the cutter support 1. The clamp further comprises an elliptical sleeve 44 through which the support member 9 may protrude when the clamp is connected to the cutter support 1.

The clamp 8 is slideably connected to the cutter support 1 between the two opposing side panels 10 and 11 of the cutter support 1. The clamp 8 is resiliently connected to the cutter support by two springs 5 and 6 that are located in the spring receiving recesses 5*a* and 6*a* and act upon the end panels 12 and 13 of the cutter support 1.

Figure 9:
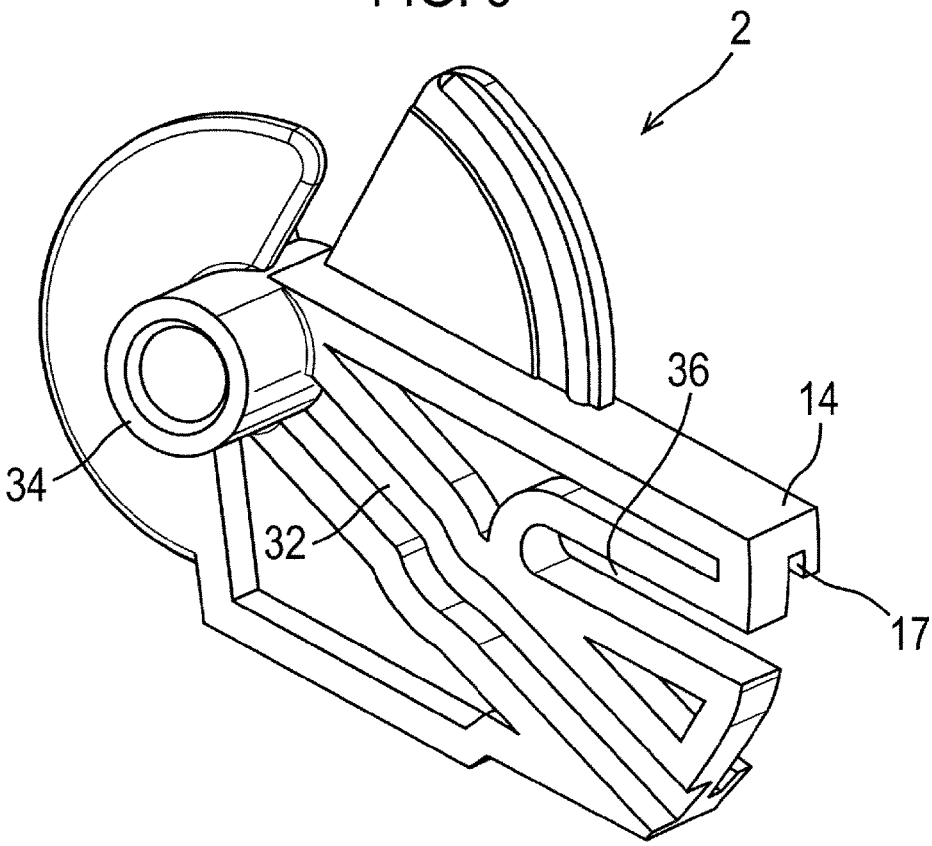
FIG. 9 shows a rotating blade support of the cutter mechanism in accordance with an embodiment of the present disclosure.

The rotating blade support 2, shown in more detail in FIG. 9, comprises a cylindrical sleeve 34 in which support member 9 of the cutter support is received such that the rotating blade support 2 is pivotally mounted on the cutter support 1. A projecting arm 14 of the rotating blade support 2 extends substantially radially from the support member 9 in the plane in which the rotating blade support 2 pivots about the support member 9.

Figure 10:
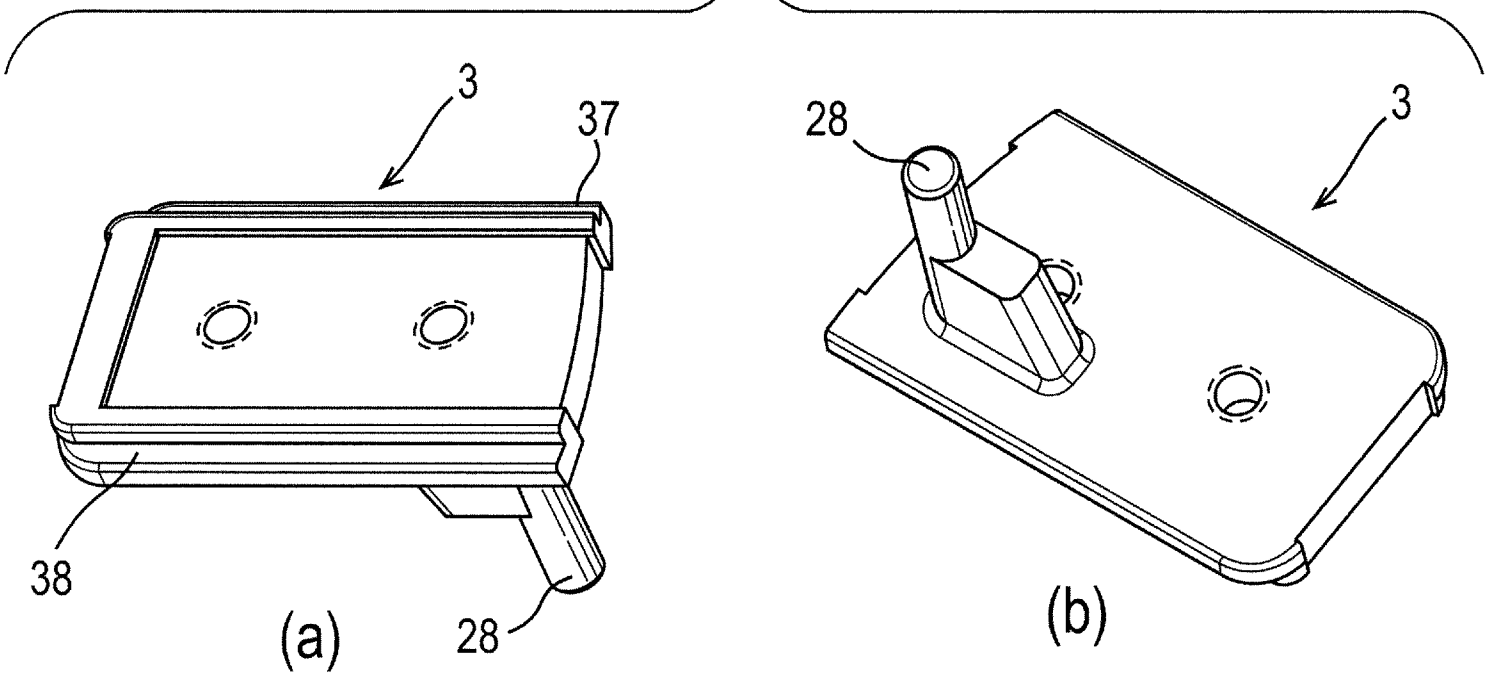
FIG. 10 shows a translating blade support of the cutter mechanism in accordance with an embodiment of the present disclosure.

The translating blade support 3 is shown from a top elevation in FIG. 10*a* and from a bottom elevation in FIG. 10*b*. The translating blade support 3 is slideably connected to the projecting arm 14 of the rotating blade support 2 by flanges 37 and 38 that correspond with a recess 17 which extends along the length of the projecting arm 14. The projecting arm 14 of the rotating blade support 2 includes a substantially rectangular shaped slot 36 (FIG. 9) through which a pin 28 of the translating blade support 3 engages with the guide track 15 located on the cutter support 1.

Figure 2:
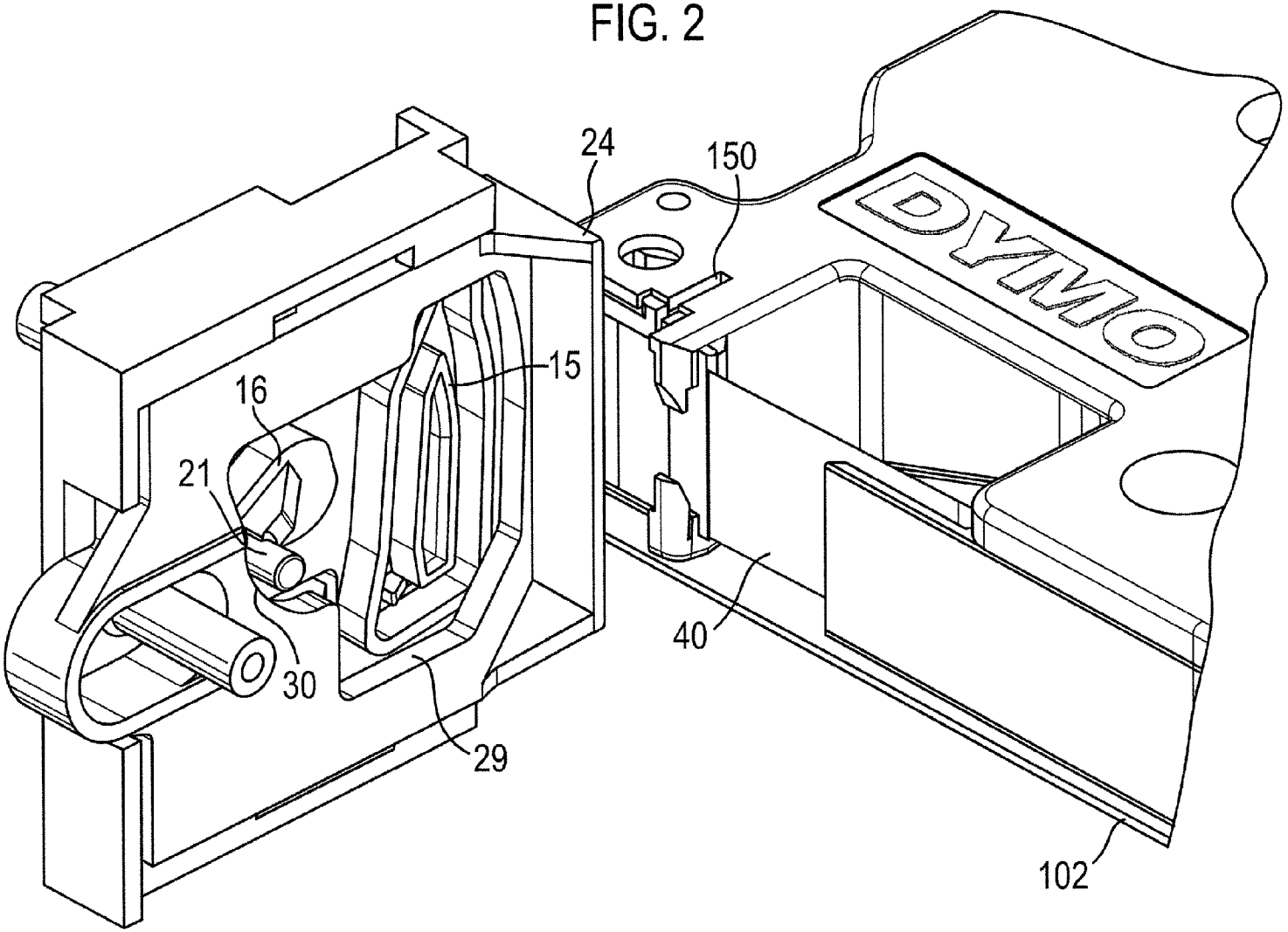
FIG. 2 shows a cutter mechanism in accordance with an embodiment of the present disclosure.

FIG. 2 shows a view of the cutter mechanism with the rotating blade support 2 removed. As shown the clamp 8 includes a cut out section 29 exposing the guide track 15 and a cutter arm 16. The cutter arm 16 is shown in more detail in FIG. 8. The cutter arm 16 comprises an elongated body 16*a* which is mounted at one end on spindle 20. A pin 21 is mounted at the opposite end of the body 16*a* from the spindle 20. The pin 21 extends perpendicular to the plane of rotation of the cutter arm 16 about the spindle 20. The spindle 20 extends through the hole 22 (FIG. 3) in the cutter support 1 so that the cutter arm 16 can be rotated in the direction 'A' by the motor 97 (FIG. 12).

The pin 21 may act against the inside edge of a region of the cut out section of the clamp 8. The pin 21 of the cutter arm 16 also projects into a narrow slot 32 (FIG. 9) in the rotating blade support 2 which extends towards the projecting arm 14 of the rotating blade support, such that when the pin 21 rotates about the spindle 20 the rotating blade support 2 is caused to reciprocate along an arc.

Reference is again made to FIG. 3 which shows the cutter support 1. In operation the pin 28 attached to the translating blade support 3 is arranged to follow the path defined by the guide track 15. In the embodiment described the predetermined path defined by the guide track is a closed loop path. Therefore the pin attached is arranged to follow the path in one direction, for example a clockwise direction indicated by arrow C.

Alternatively the predetermined path may be a single path having two ends that the pin 28 must reciprocate between in order to for the translating blade support to move through a complete cutting cycle.

Two stepped edges 22 and 23 are provided along at the points in the path. The purpose of the stepped edges 22 and 23 is to prevent the pin 28 from moving in an anti clockwise direction when changing direction at the extremes of the oval path of the guide track 15.

As shown in FIG. 2, the cutting mechanism is orientated relative to the image receiving tape 40 such that the clamping face 24 of the clamp 8 extends across the width of the tape at the cutting zone 59.

During printing the clamp is held in a retracted position against springs 5 and 6, away from the tape. The clamp is held in the retracted position when the cutter arm 16 is in the home position as shown in FIG. 2. When the cutter arm is in the home position the pin 21 of the cutter arm 16 abuts against the end of an arc 30 section in the cut out portion of the clamp 8 as shown.

The operation of the cutting mechanism according to an embodiment of the disclosure will now be described with reference to FIGS. 4, 5, 6 and 7.

Figure 4A:
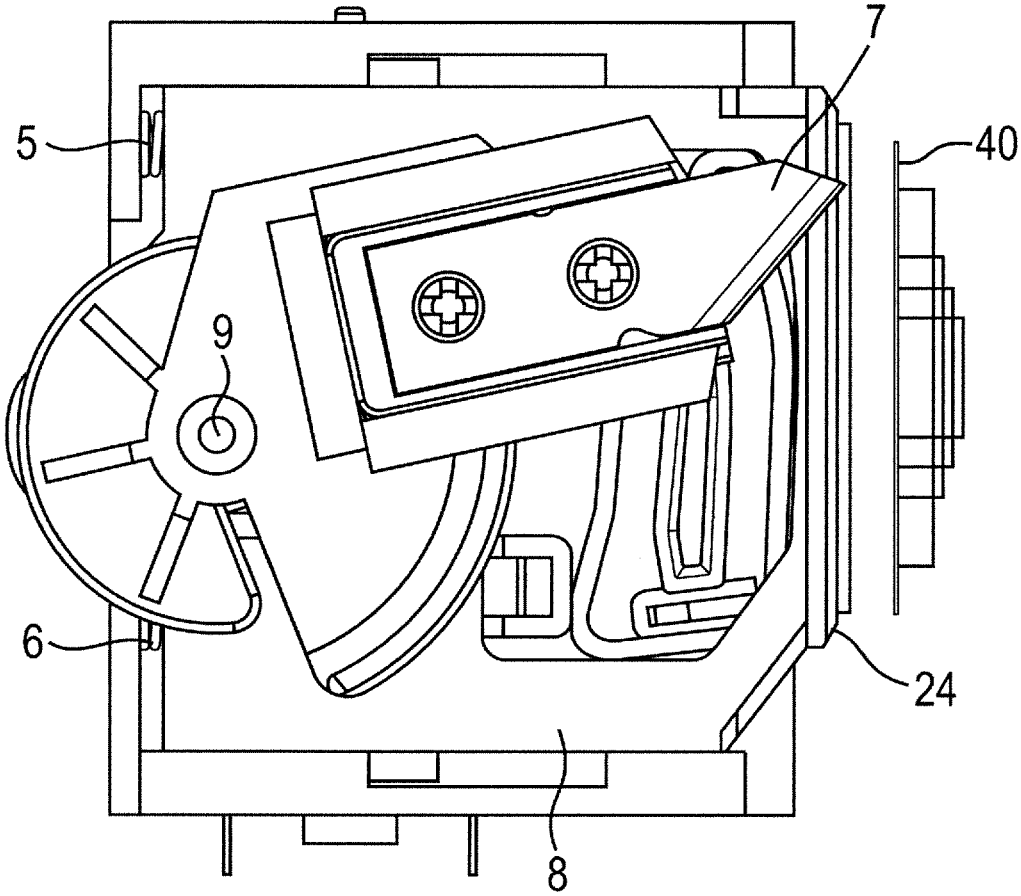
FIG. 4*a* shows the position of a blade of the cutter mechanism in relation to the tape in accordance with an embodiment of the present disclosure.

FIG. 4*a* shows the position of the blade relative to the tape 40 when the cutter arm is in the home position. As shown the clamp 8 and blade 7 are retracted away from the tape. The position of the rotating blade support is controlled by the position of arm 21 of the cutter arm 16 in slot 32 of the rotating blade.

Figure 4B:
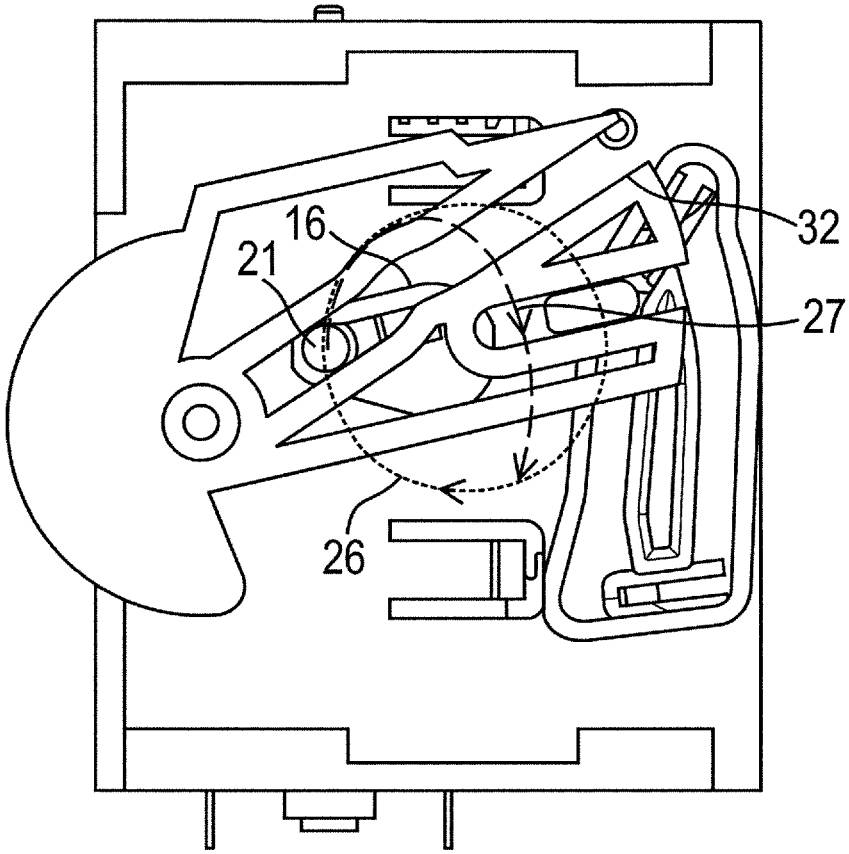
FIG. 4*b* shows the position of a cutter arm of the cutter mechanism during cutting in accordance with an embodiment of the present disclosure.

FIG. 4*b* shows the corresponding position of the pin 21 within the slot 32 of the rotating blade support when the cutter arm 16 is in the home position. FIG. 4*b* also shows the path of motion 26 of the pin 21 and the path of motion 27 of the slot 32.

Figure 4C:
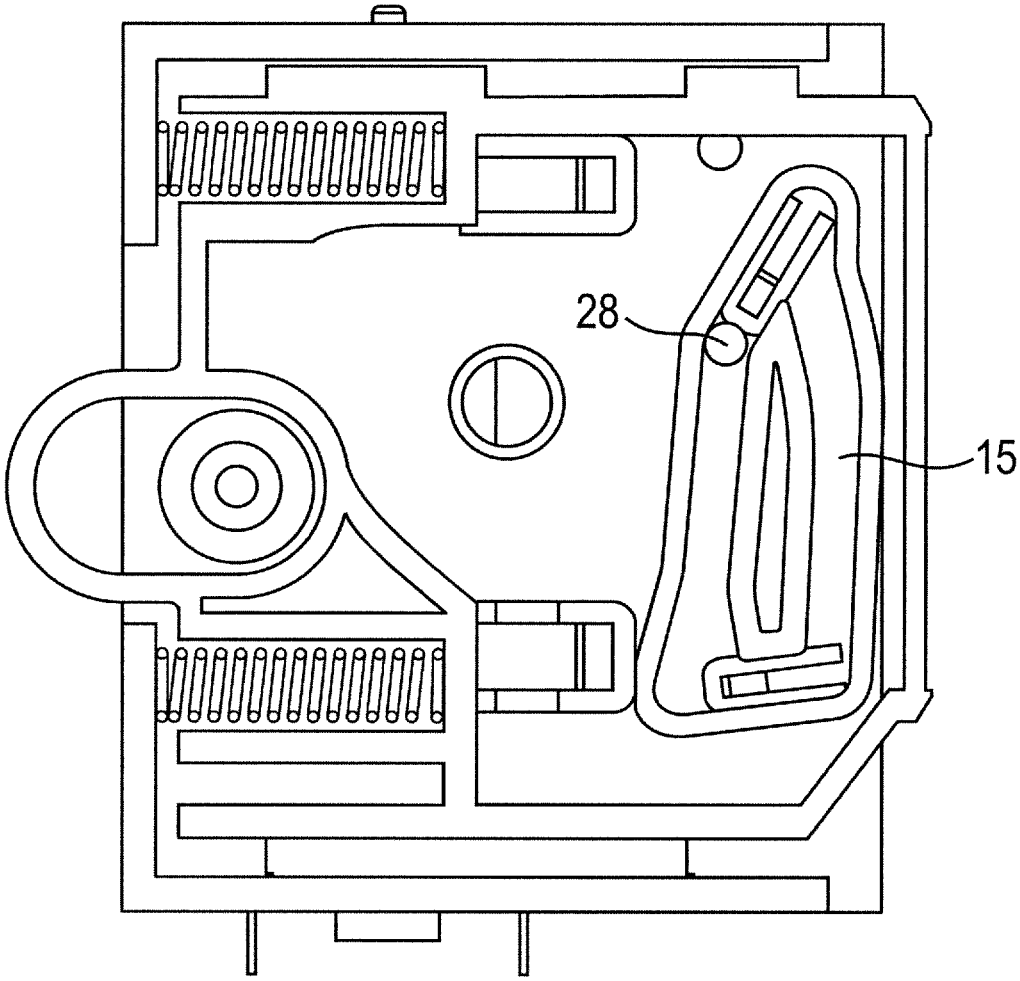
FIG. 4*c* shows the position of a pin in a guide track of the cutter mechanism in accordance with an embodiment of the present disclosure.

The position of the rotating blade support 2 controls the position of the pin 28 (FIG. 10), which projects from the translating blade support 3, in the guide track 15. FIG. 4*c* shows the corresponding position of the pin 28 in the guide track 15 when the cutter arm is in the home position. When the pin is at the position shown in FIG. 4*c* the translating blade support which holds the blade will be completely retracted within the arm 14 of the rotating blade support 2.

Figure 8:
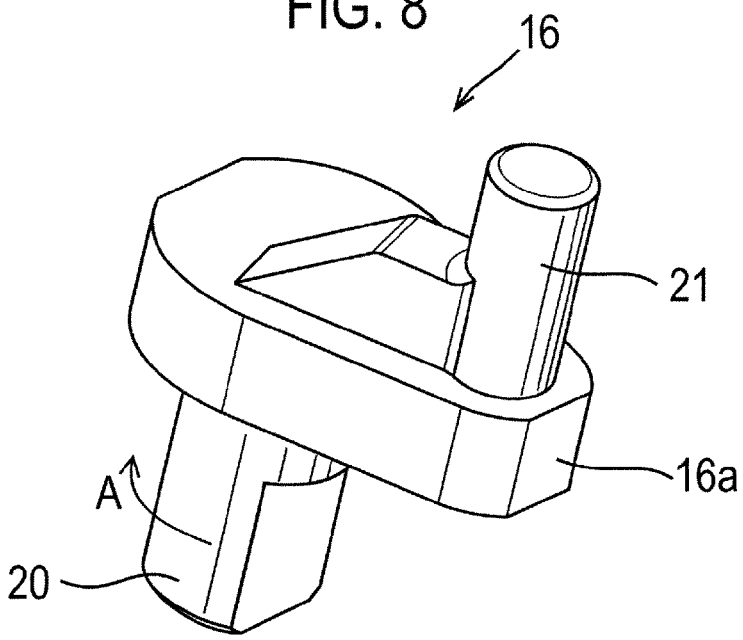
FIG. 8 shows a cutter arm of the cutter mechanism in accordance with an embodiment of the present disclosure.

When a cutting operation is initiated by the processor 200, the motor 97 is controlled by the processor 200 to drive the spindle 20 of the cutter arm in the direction 'A' shown in FIG. 8 such that the pin 21 of the cutter arm disengages with the arc 30 of the cut out section 29 in the clamp 8. The clamp is biased towards the tape by springs 5 and 6. When the cutter arm disengages with the arc 30, the clamp is forced towards the tape 40. The clamp face 24 clamps the tape onto the housing of the cassette. In an alternative embodiment of the invention the clamp may be arranged to clamp the tape onto the housing of the printer or any other surface fixed relative to the body of the printer.

Figure 5A:
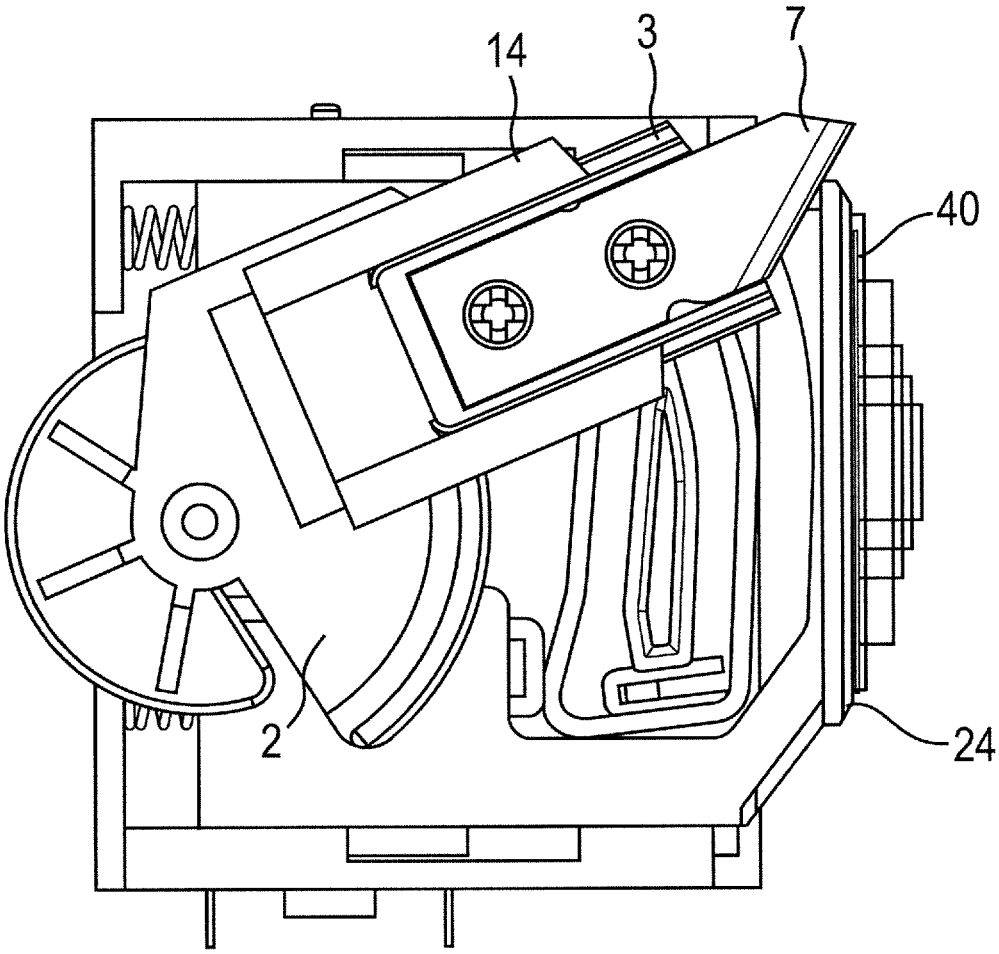
FIG. 5*a* shows the position of a blade of the cutter mechanism in relation to the tape in accordance with an embodiment of the present disclosure.

FIG. 5*a* shows the position of the blade relative to the tape 40 when the cutter arm 16 is rotated clockwise from the home position. In this position the clamp 8 is positioned against the tape 40 and the blade 7 and translating blade support are above the tape 40.

Figure 5B:
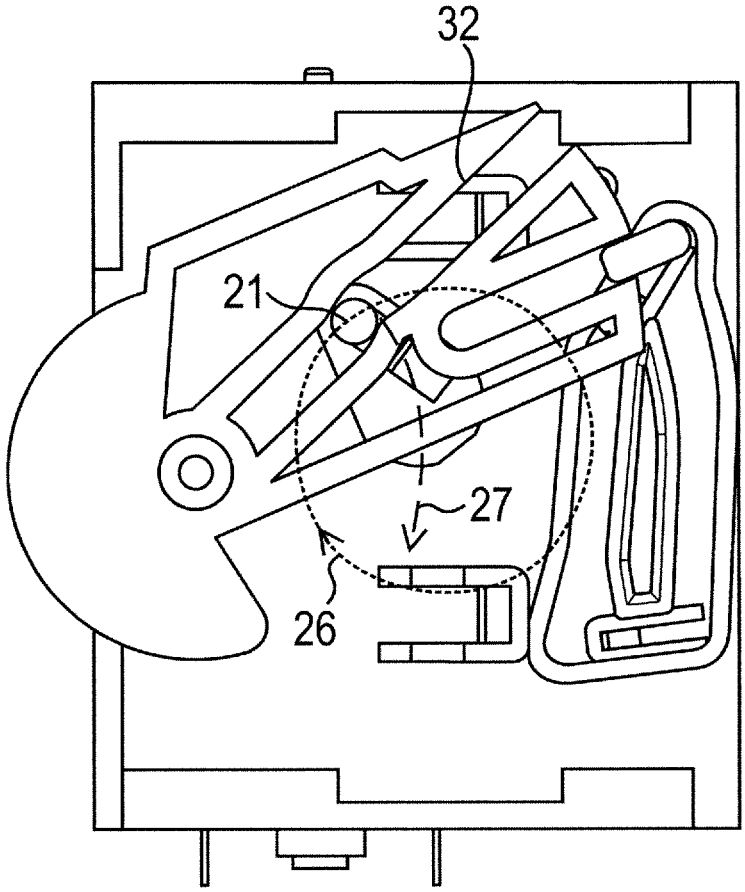
FIG. 5*b* shows the position of a cutter arm of the cutter mechanism during cutting in accordance with an embodiment of the present disclosure.

FIG. 5*b* shows the corresponding position of the pin 21 within the slot 32 of the rotating blade support 2 when the cutter arm is rotated clockwise from the home position. As shown, when the rotating blade support is at the upper position the slot is at one end of the path of motion 27.

Figure 5C:
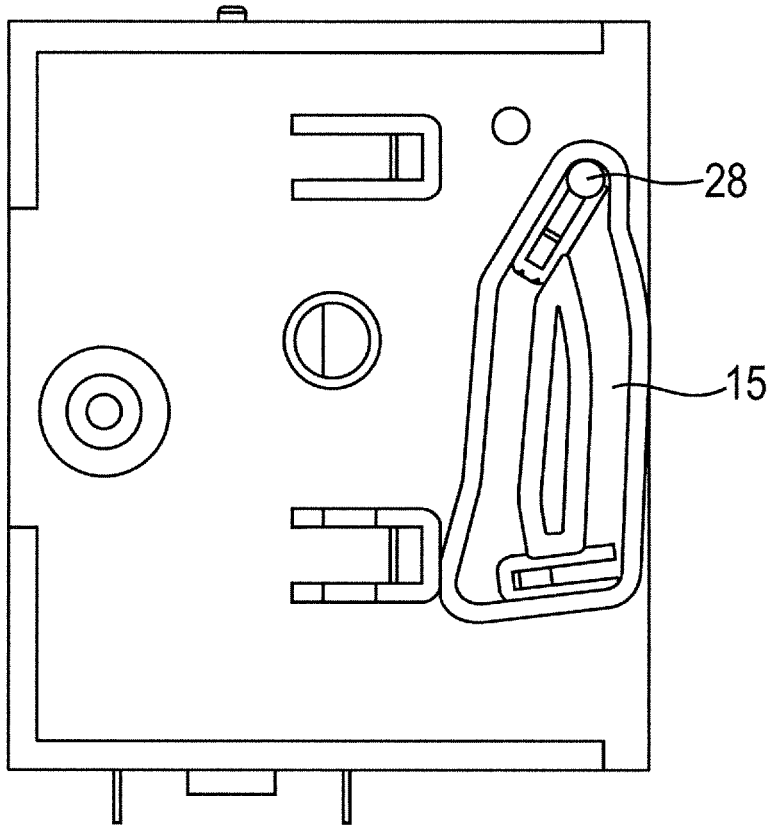
FIG. 5*c* shows the position of a pin in a guide track of the cutter mechanism in accordance with an embodiment of the present disclosure.

FIG. 5*c* shows the corresponding position of the pin 28 in the guide track 15 when the rotating blade support is in the upper position. When the pin 28 is at the position shown in FIG. 5*c* the translating blade support 3 which holds the blade will be partially extended from the arm 14 of the rotating blade support 2 to which it is slideaby connected.

Figure 6A:
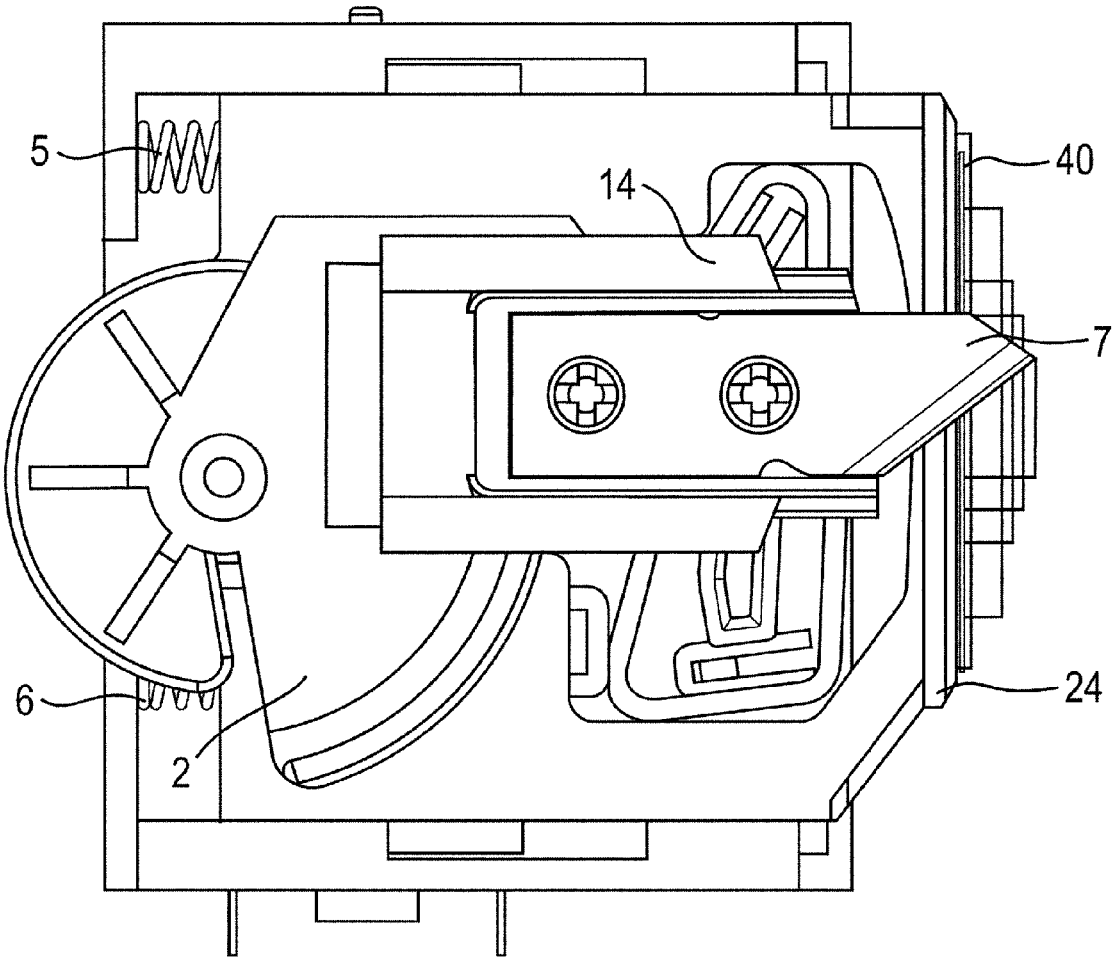
FIG. 6*a* shows the position of a blade of the cutter mechanism in relation to the tape in accordance with an embodiment of the present disclosure.

FIG. 6*a* shows the position of the blade relative to the tape 40 when the cutter arm is rotated clockwise from the position shown in FIG. 5*a*. In this position the clamp 8 remains against the tape 40 and the blade 7 is midway through cutting the tape 40.

Figure 6B:
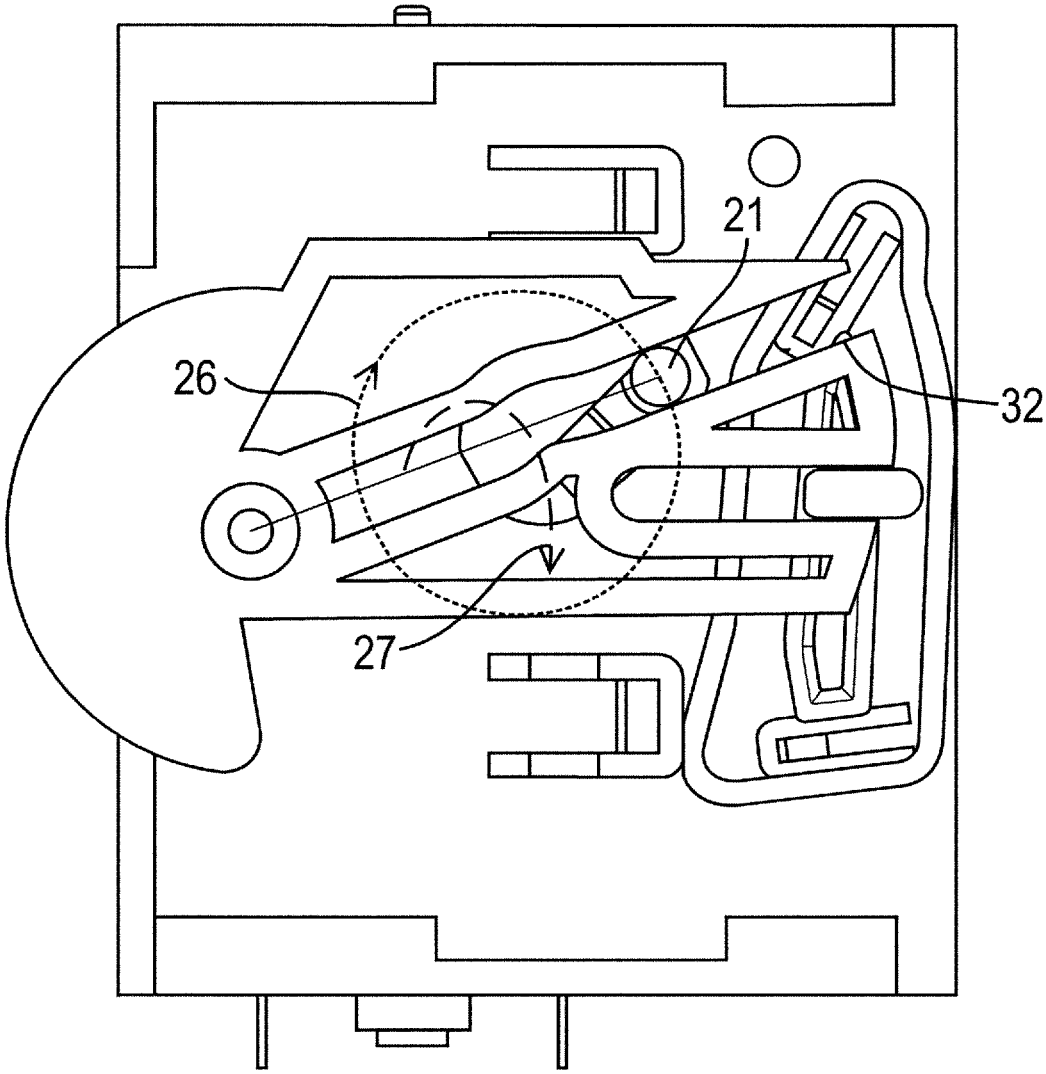
FIG. 6*b* shows the position of a cutter arm of the cutter mechanism during cutting in accordance with an embodiment of the present disclosure.

FIG. 6*b* shows the corresponding position of the pin 21 within the slot 32 of the rotating blade support when the cutter arm is rotated clockwise from the position shown in FIG. 5*b*. As shown the rotating blade support is between the two extremes of the path 27 followed by the slot 32.

Figure 6C:
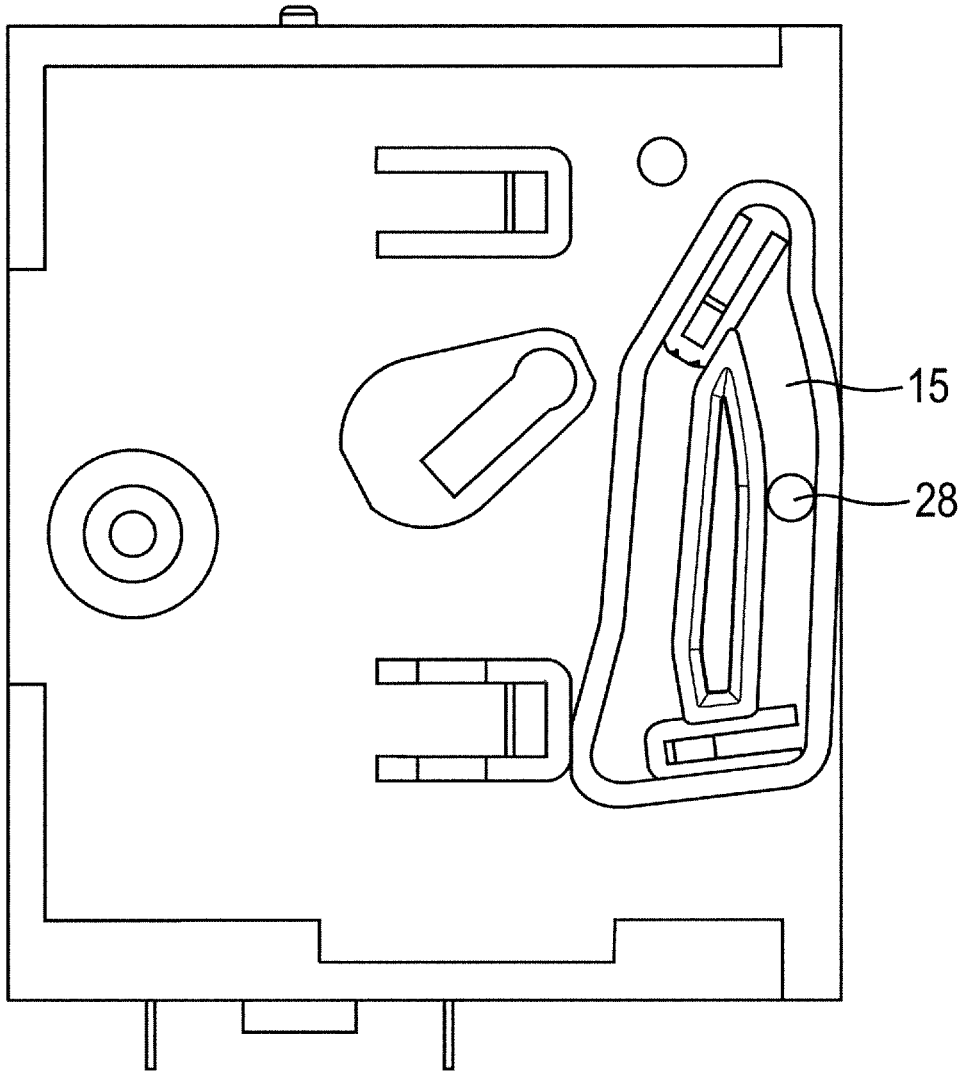
FIG. 6*c* shows the position of a pin in a guide track of the cutter mechanism in accordance with an embodiment of the present disclosure.

FIG. 6*c* shows the corresponding position of the pin 28 in the guide track 15 when the rotating blade support is midway through the cutting position. When the pin is at the position shown in FIG. 6*c* the translating blade support 3 which holds the blade 7 will be partially extended from the arm 14 of the rotating blade support 2 to which it is slideaby connected. In one embodiment of the disclosure the distance from the pivot 9 to the position of the pin 28 on the path in FIG. 5*c* is greater than the distance from the pivot 9 to the position of the pin 28 on the path in FIG. 6*c*. This causes the translating blade support to be retracted slightly when the rotating blade support 2 moves from the upper position as shown in FIG. 5 to the mid cutting position as shown in FIG. 6. This advantageously causes different points along the blade to intersect the tape as the blade transverses and cuts the tape. This prevents excessive wear on one point on the blade 7. This also prevents a build up of adhesive on the blade when cutting the adhesive layer of the tape.

Figure 7A:
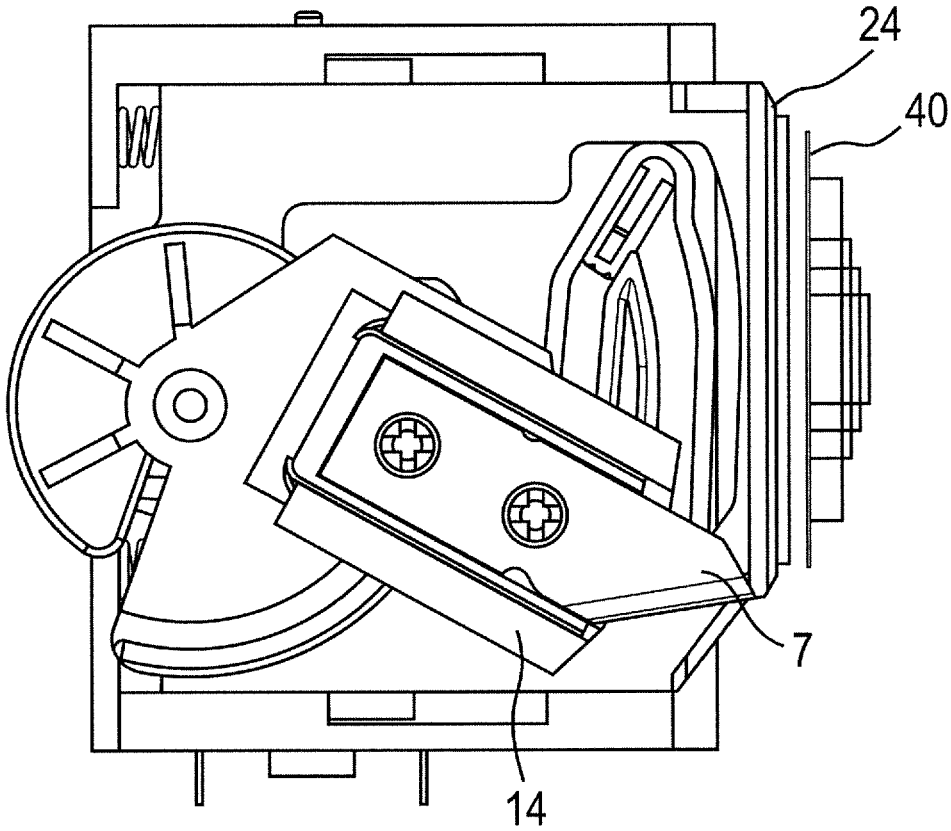
FIG. 7*a* shows the position of a blade of the cutter mechanism in relation to the tape in accordance with an embodiment of the present disclosure.

FIG. 7*a* shows the position of the blade relative to the tape 40 when the cutter arm is rotated clockwise from the position of the cutter arm in FIG. 6*a*. In this position the clamp 8 remains against the tape 40 and the blade 7 has completed cutting the tape 40.

Figure 7B:
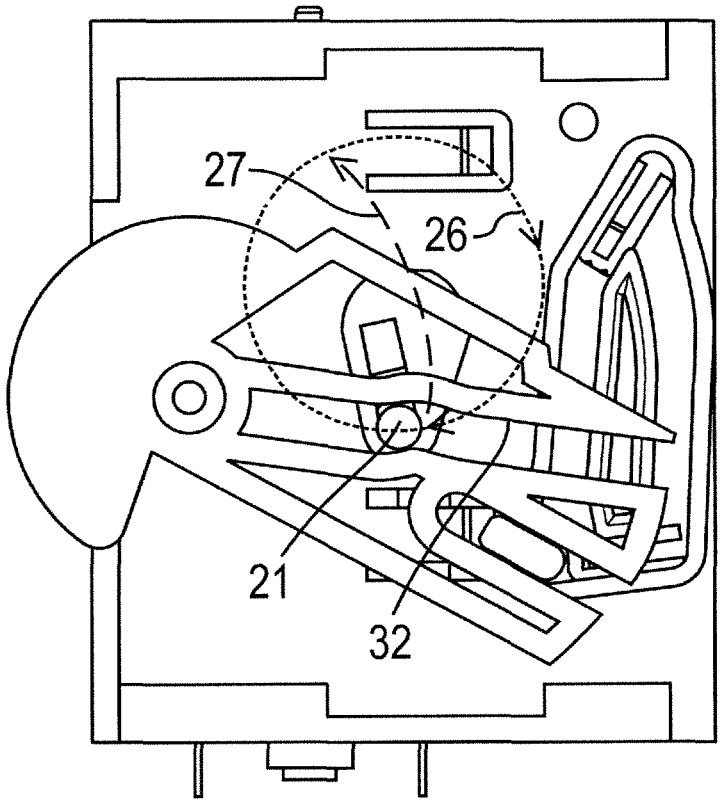
FIG. 7*b* shows the position of a cutter arm of the cutter mechanism during cutting in accordance with an embodiment of the present disclosure.

FIG. 7*b* shows the corresponding position of the pin 21 within the slot 32 of the rotating blade support 2 when the cutter arm is rotated clockwise from the position of the cutter arm shown in FIG. 6*b*. As shown the rotating blade support is at the furthest point in the path 27.

Figure 7C:
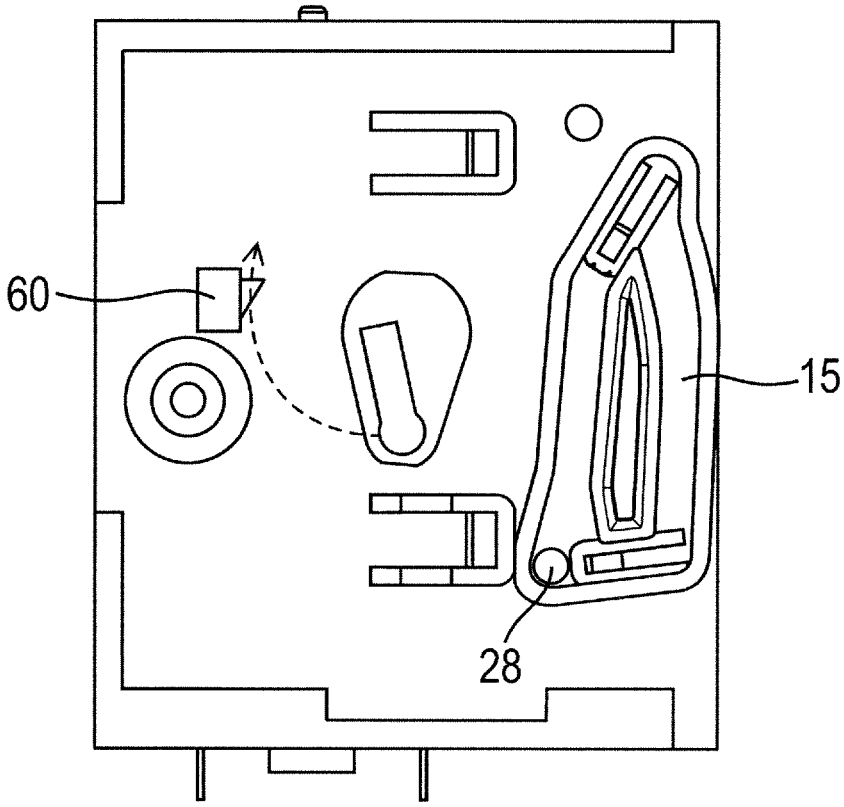
FIG. 7*c* shows the position of a pin in a guide track of the cutter mechanism in accordance with an embodiment of the present disclosure.

FIG. 7*c* shows the corresponding position of the pin 28 in the guide track 15 when the rotating blade support is at the lowest point in its path of motion. When the pin is at the position shown in FIG. 7*c* the translating blade support 3 which holds the blade 7 will be retracted further along the arm 14 of the rotating blade support 2 to which it is slideaby connected.

The motor continues to rotate the spindle 20 until the cutter arm 16 returns to the home position as shown in FIGS. 2 and 4*b*. As the cutter arm rotates towards the home position the arm 21 of the cutter arm 16 abuts against the arc 30 of the cut out section 29 of clamp 8. The cutter arm retracts the clamp away from the tape and moves the rotating blade support to the position as shown in FIG. 4*a*.

When the rotating blade support moves upwards towards the home position the pin 28 connected to the translating blade support 2 continues to follow the guide track back to the position as shown in FIG. 4*c*. Since the distance between this portion of the path followed by the pin during the upward movement of the blade and the pivot 9 is less than the distance between the portion of the path followed by the pin during the downward movement of the blade and the pivot 9, the blade is retracted when the rotating blade support returns to the home position. Accordingly when the rotating blade support returns to the home position the blade is retracted along the arm 14 and held away from the tape 40.

Figure 15:
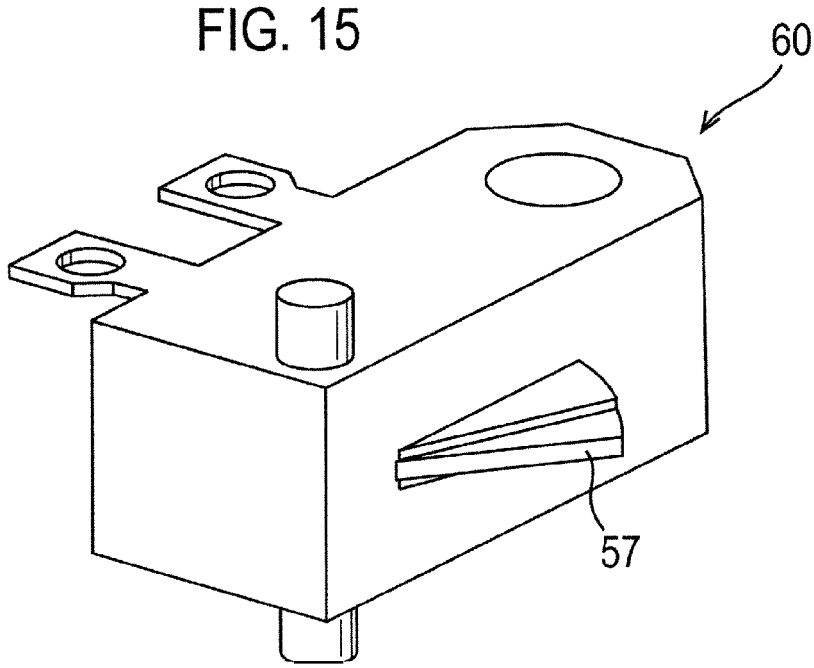
FIG. 15 shows a switch used to detect the home position of the cutter arm in accordance with an embodiment of the present disclosure.

According to an embodiment of the disclosure, the home position of the cutter arm 16 may be detected by a switch 60. FIG. 15 shows a plunger switch 60 that may be used to detect the home position of the cutter arm 16. The plunger switch 60 includes a sloped plunger 57. The switch 60 may be attached to the cutter support 1 at a location, as shown in FIG. 7*c*, that causes the plunger 57 to be depressed when the cutter arm returns to the home position. When the plunger 57 is depressed a signal is sent from the switch 60 to the microprocessor chip 200 to indicate that the cutter arm has returned to the home position and that the cutting cycle is complete. In response to the signal received from the switch 60 the microprocessor controls the motor 97 to stop the rotation of the cutter arm 16.

In a preferred embodiment of the disclosure the blade is arranged to move along the width of the tape 40.

When the cutting mechanism is orientated relative to the tape as shown in FIG. 2, any force exerted by cutting the tape when blade moves though the cutting cycle shown in FIGS. 4 to 7 is directed toward the base of the cassette receiving bay 102. As such the force caused by cutting the tape will not displace the position of the tape.

A further embodiment of the disclosure will now be described with reference to FIGS. 16 and 17.

During a cutting cycle, when the blade 7 is in contact with the tape, the translating blade support 3 is extended from the projecting arm 14 of the rotating blade support 2. In this extended position the lateral support provided for the blade, which is perpendicular to the plane of the blade, is limited.

Figure 18:
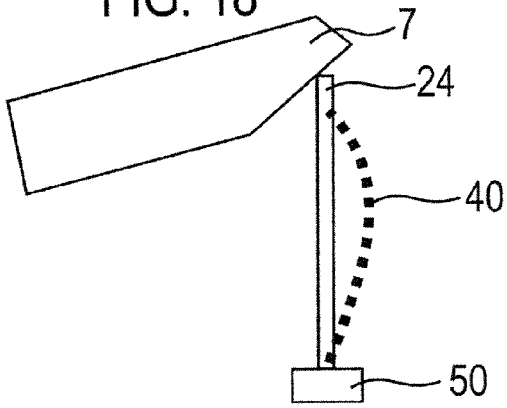
FIG. 18 shows the distortion of the tape during a cutting operation.

When the blade 7 is in contact with the tape, the interaction of the blade 7 and the tape causes a force to act on the tape. This causes the tape 40 to distort as shown in FIG. 18. This is particularly pronounced when a projection of the tape cassette 50 supports the bottom edge of the tape.

Similarly when the blade interacts with the tape a force also acts on the blade. Without lateral support to guide the path of the blade during the cutting cycle, the path of motion of the blade will be offset by the resistance provided by the tape, thus causing an irregular cut surface that is not straight and smooth.

In the embodiments of the invention described thus far, the blade may be supported on one side by the edge of the clamping face 24 of the clamp 8 as shown in FIG. 1. The support provided by the clamping face 24 in the embodiment shown in FIG. 1 will however not prevent the blade from moving away from the edge of the clamping face during the cutting cycle.

Also, the lateral movement of the blade 7 may also be restricted by a slot 150 located in the housing of the tape cassette as shown in FIG. 2. However, since the purpose of the slot 150 in the housing of the tape cassette is to accommodate the blade 7 during a cutting cycle, the dimensions of the slot 150 in the cassette are not suited to providing lateral support to the blade during the cutting cycle, especially when the tape cassette is designed for use in more than one type of printer.

According to an embodiment of the invention that is provided to solve this problem, the clamp 8 is arranged to prevent the tape from distorting and to provide lateral support on both sides of the blade when the blade is in contact with the tape.

Figure 16:
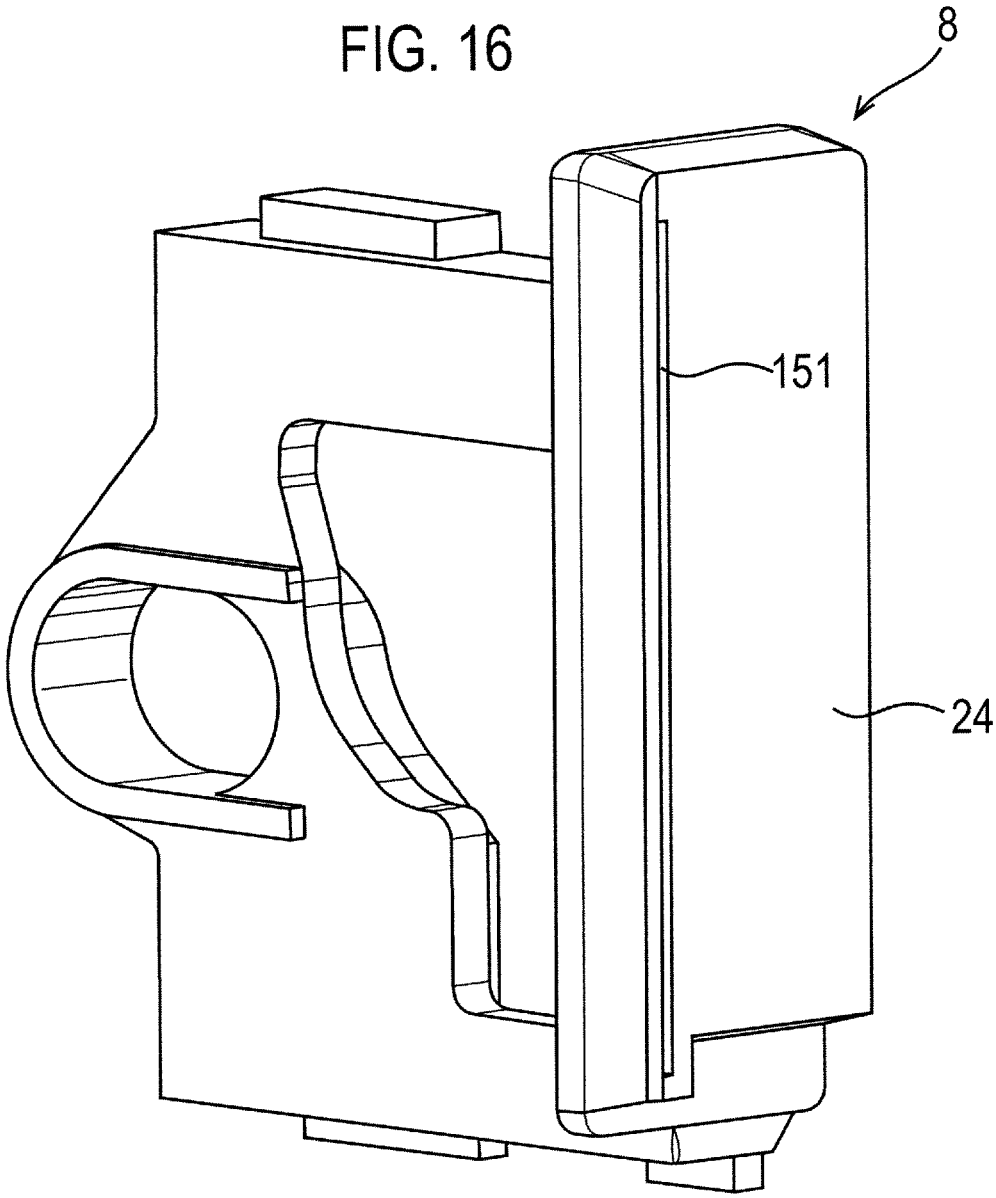
FIG. 16 shows the clamp of the cutter mechanism in accordance with a further embodiment of the present disclosure.

As shown in FIG. 16 a slot 151 is provided in the clamping face 24 of the claim 8.

Figure 17:
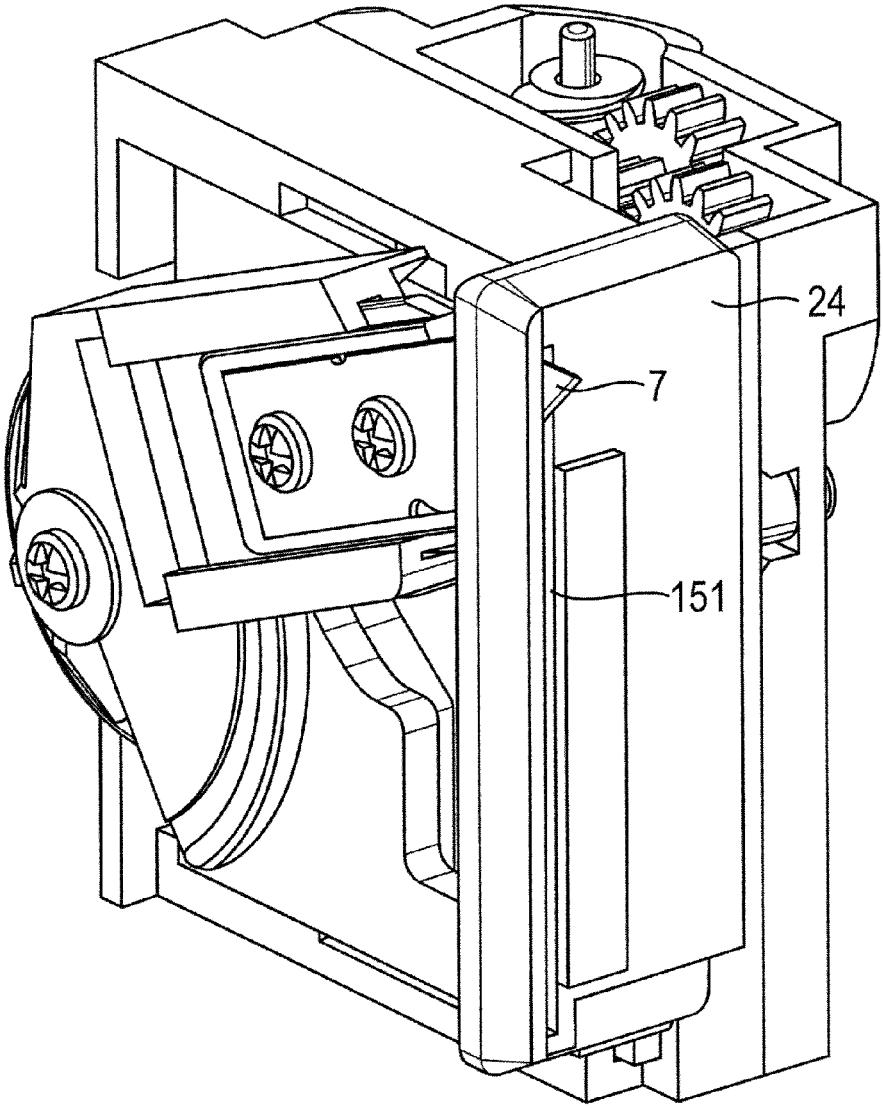
FIG. 17 shows the cutter mechanism in accordance with a further embodiment of the present disclosure.

Referring now to FIG. 17, the slot 151 in the clamping face 24 of the clamp 8 is arranged to receive the blade 7, such that during the cutting cycle the blade 7 will extend through the slot to contact the tape.

In one embodiment of the disclosure the blade may only extend through the slot 151 when the translating blade support member 3 is extended and the blade is in the cutting position.

In a preferred embodiment of the disclosure the blade may also be arranged to extend into the slot when the blade is retracted and the rotating blade support is in the home position. This arrangement will prevent the blade from jamming behind the clamping face. In order to prevent the blade from jamming it is not necessary for the blade to extend through the slot. Instead it is sufficient for the blade to project into the slot such that the blade 7 is supported by an internal wall of the slot 151.

As the clamping face 24 of the clamp 8 is arranged to clamp the tape on either side of the blade 7 while the tape is being cut by the blade, this prevents the tape from distorting during the cutting operation.

A further advantage of clamping the tape on either side of the blade is that the clamp provides lateral support on both sides of the blade. This ensures that the cut surface of the tape is straight.

A further advantage to clamping the tape on either side of the blade is that the tape is held in place on either side of the blade while the tape is being cut.

Whilst the embodiments of the present disclosure have been described in relation to tape printers, embodiments of the present disclosure may also be applied to other printers, such as laser printers, PC printers and stand alone printers, having a cutting mechanism that is used to cut off the image receiving medium.

Printers embodying the present disclosure may be capable of monochrome printing, grayscale printing or full colour printing.

The present disclosure may include any feature or combination of features disclosed herein either implicitly or explicitly or any generalization thereof, without limitation to the scope of any of the present claims. In view of the foregoing description it will be evident to a person skilled in the art that various modifications may be made within the scope of the invention.

The invention claimed is:

1. A tape printer for printing an image on an image receiving medium comprising: a tape receiving portion for receiving a supply of image receiving medium on which an image is to be printed; a printing mechanism arranged to print an image on said medium; a cutting mechanism for cutting off a portion of said medium, wherein the cutting mechanism comprises a cutter guide track defining a predetermined path having a shape for guiding a blade of the cutting mechanism during a cutting cycle, wherein said cutting mechanism comprises a translating blade support to which the blade is fixed, said translating blade support comprising engagement means for engaging said translating blade support with the guide track, such that in operation the engagement means and the translating blade support are arranged to follow said shape of said predetermined path of said cutter guide track and the blade of the cutting mechanism follows said predetermined path of the cutter guide track during the cutting cycle, during the cutting cycle, and therefore the path followed by the blade of the cutting mechanism, is curved, and different portions of the blade intersect the medium as the blade moves to cut off said portion of said medium.

2. A tape printer as claimed in claim 1 wherein the path is a closed loop.

3. A tape printer as claimed in claim 1 wherein the blade is arranged to return to a first position on the path to complete a cutting cycle.

4. A tape printer as claimed in claim 3 wherein during a first portion of the cutting cycle the blade is arranged to contact the medium such that the portion of the medium is cut off, and wherein during a second portion of the cycle the blade is arranged to return to the first position.

5. A tape printer as claimed in claim 4 wherein the blade does not intersect with a plane of the medium during the second portion of the cycle.

6. A tape printer as claimed in claim 3 wherein the printer further includes clamping means for clamping the image receiving medium when the blade is located in the first portion of the cutting cycle.

7. A tape printer as claimed in claim 6 wherein the clamping means is arranged to clamp the medium at opposite sides of a cutting plane of the blade.

8. A tape printer as claimed in claim 6 wherein the clamping means comprises a slot through which the cutter extends during the first portion of the cutting cycle.

9. A tape printer as claimed in claim 6 wherein the driving means is further arranged to drive the clamping means to release the image receiving medium.

10. A tape printer as claimed in claim 1 wherein the blade is arranged to move along at least one plane relative to the blade support.

11. A tape printer as claimed in claim 1 wherein the blade support is arranged to pivot in an arc about an axis that is fixed relative the tape printer housing.

12. A tape printer as claimed in claim 11 further comprising: driving means for driving the blade support to pivot in the arc about the fixed axis.

13. A tape printer as claimed in claim 11 wherein during the first portion of the cutting cycle the engagement means is arranged to pivot about the axis at a first radius and wherein during the second cycle the engagement means is arranged to pivot about the axis at a second radius, such that the first radius is greater than the second radius.

14. A tape printer as claimed in claim 1 wherein the medium is a tape.

15. A tape printer as claimed in claim 1 wherein the medium comprises die cut labels.

16. A method of cutting a portion of an image receiving medium to form a label comprising; guiding a blade support to which a blade is affixed to move along a guide track to which said blade support is engaged with engagement means, said guide track defining a predetermined path having a shape, such that the engagement means and the blade support follow said shape of said predetermined path and the blade of the cutting mechanism follows said predetermined path of the guide track during a cutting cycle, during the cutting cycle, and therefore the path followed by the blade of the cutting mechanism, is curved, and wherein different portions of the blade intersect the image receiving medium as the blade moves to cut off said portion of said image receiving medium.

17. A method as claimed in claim 16 wherein the blade returns to a first position on the path to complete a cutting cycle.

18. A method as claimed in claim 17 wherein during a first portion of the cutting cycle the blade contacts the medium such that a portion of the medium is cut off, and wherein during a second portion of the cycle the blade returns to the first position.

19. A method as claimed in claim 18 wherein the blade does not intersect with a plane of the medium during the second portion of the cycle.

20. A method as claimed in claim 18 wherein the method further comprises:

clamping the medium as the blade moves along the first portion of the cutting cycle.

21. A method as claimed in claim 20 wherein the step of clamping the medium as the blade moves along the first portion of the cutting cycle comprises clamping the medium at opposite sides of a cutting plane of the blade.

22. A method as claimed in claim 20 wherein the blade extends through a slot provided in the clamp during the first portion of the cutting cycle.

23. A method as claimed in claim 20 wherein the method further comprises:

releasing the medium from the clamp as the blade moves along the second portion of the cutting cycle.

24. A method as claimed in claim 16 wherein the blade pivots about a fixed axis as the blade is guided to move along the path.

25. A printer for printing an image on an image receiving medium comprising: a receiving portion for receiving a supply of image receiving medium on which an image is to be printed; a printing mechanism arranged to print an image on said medium; a cutting mechanism for cutting off a portion of said medium, wherein the cutting mechanism comprises a cutter guide track defining a predetermined path having a shape for guiding a blade of the cutting mechanism, wherein said cutting mechanism comprises a translating blade support to which the blade is fixed, said translating blade support comprising engagement means for engaging said translating blade support with the guide track, such that in operation the engagement means and the translating blade support are arranged to follow said shape of said predetermined path of said cutter guide track, the blade of the cutting mechanism follows said predetermined path of the cutter guide track during a cutting cycle, during the cutting cycle, and therefore the path followed by the blade of the cutting mechanism, is curved, and different portions of the blade intersect the medium as the blade moves to cut off said portion of said medium.

26. A tape printer for printing an image on an image receiving medium comprising: a tape receiving portion for receiving a supply of image receiving medium on which an image is to be printed; a printing mechanism arranged to print an image on said medium; and a cutting mechanism for cutting off a portion of said medium, wherein the cutting mechanism comprises a cutter guide track defining a predetermined path for guiding a cutter of the cutting mechanism during a cutting cycle, the blade of the cutting mechanism follows said predetermined path of the cutter guide track during a cutting cycle, during the cutting cycle, and therefore the path followed by the blade of the cutting mechanism, is curved, wherein during a first portion of the cutting cycle the guide track is arranged to guide the cutter from a home position to intersect a plane of the medium such that a portion of the medium is cut off, and wherein during a second portion of the cycle the guide track is arranged to guide the cutter to return to the home position such that the cutter does not intersect the plane of the medium, and wherein during the first portion of the cutting cycle the cutter moves away from said home position along a different path to a path followed by the cutter when returning to said home position in the second portion of the cutting cycle.

27. A method of cutting an image receiving medium to form a label comprising: guiding a cutter to move along a predetermined path during a cutting cycle, wherein during a first portion of the cutting cycle the guide track is arranged to guide the cutter from a home position to intersect a plane of the medium such that a portion of the medium is cut off, and wherein during a second portion of the cycle the guide track is arranged to guide the cutter to return to the home position such that the cutter does not intersect the plane of the medium, and wherein during the first portion of the cutting cycle the cutter moves away from said home position along a different path to a path followed by the cutter when returning to said home position in the second portion of the cutting cycle, and wherein, in guiding the cutter to move along the predetermined path, during the cutting cycle, and therefore the path followed by the cutter, is curved.

* * * * *

UNITED STATES PATENT AND TRADEMARK OFFICE

CERTIFICATE OF CORRECTION

PATENT NO. : 8,517,619 B1
APPLICATION NO. : 12/091276
DATED : August 27, 2013
INVENTOR(S) : Vandermeulen It is certified that error appears in the above-identified patent and that said Letters Patent is hereby corrected as shown below:

IN THE CLAIMS:

In Column 10, Lines 7-8, in Claim 1, delete "during the cutting cycle, during the cutting cycle," and insert -- during the cutting cycle, --, therefor.

In Column 10, Line 65, in Claim 16, delete "during a cutting cycle, during the cutting cycle," and insert -- during a cutting cycle, --, therefor.

In Column 12, Line 2, in Claim 25, delete "during a cutting cycle, during the cutting cycle," and insert -- during a cutting cycle, --, therefor.

In Column 12, Lines 16-17, in Claim 26, delete "during a cutting cycle, during the cutting cycle," and insert -- during a cutting cycle, --, therefor.

Signed and Sealed this
Twenty-fourth Day of February, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,517,619 B1
APPLICATION NO. : 12/091276
DATED : August 27, 2013
INVENTOR(S) : Kris Vandermeulen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 111 days.

Signed and Sealed this
Fifteenth Day of September, 2015

Michelle K. Lee

Michelle K. Lee
*Director of the United States Patent and Trademark Office*